US010001275B2

(12) United States Patent
Cody

(10) Patent No.: US 10,001,275 B2
(45) Date of Patent: Jun. 19, 2018

(54) AIMABLE WELL TEST BURNER SYSTEM

(71) Applicant: Halliburton Energy Services, Inc., Houston, TX (US)

(72) Inventor: Trace Wayne Cody, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 356 days.

(21) Appl. No.: 14/758,296

(22) PCT Filed: Feb. 1, 2013

(86) PCT No.: PCT/US2013/024281
§ 371 (c)(1),
(2) Date: Jun. 29, 2015

(87) PCT Pub. No.: WO2014/120237
PCT Pub. Date: Aug. 7, 2014

(65) Prior Publication Data

US 2015/0354814 A1 Dec. 10, 2015

(51) Int. Cl.

| | |
|---|---|
| ***F23D 23/00*** | (2006.01) |
| ***F23G 7/05*** | (2006.01) |
| ***F23Q 9/00*** | (2006.01) |
| ***F23C 5/06*** | (2006.01) |
| ***F23D 11/36*** | (2006.01) |
| ***F23D 11/38*** | (2006.01) |
| ***F23D 99/00*** | (2010.01) |

(52) U.S. Cl.
CPC ..... *F23G 7/05* (2013.01); *F23C 5/06* (2013.01); *F23D 11/36* (2013.01); *F23D 11/38* (2013.01); *F23D 23/00* (2013.01); *F23D 91/02* (2015.07); *F23Q 9/00* (2013.01); *F23D 2202/00* (2013.01); *F23D 2205/00* (2013.01)

(58) Field of Classification Search
CPC . F23G 7/05; F23D 91/02; F23D 11/36; F23D 11/38; F23D 23/00; F23D 2202/00; F23D 2205/00; F23C 5/06; F23Q 9/00
USPC ..... 431/2
See application file for complete search history.

(56) References Cited

U.S. PATENT DOCUMENTS

| | | |
|---|---|---|
| 3,185,202 A | 5/1965 | Mitchell et al. |
| 3,565,562 A | 2/1971 | Drivet |

(Continued)

FOREIGN PATENT DOCUMENTS

| | | |
|---|---|---|
| EP | 0454351 | 4/1991 |
| JP | 04-225705 | 8/1992 |

(Continued)

OTHER PUBLICATIONS

PCT International Preliminary Report on Patentability, PCT/US2013/024281, dated Aug. 13, 2015, 10 pages.

(Continued)

*Primary Examiner* — Alfred Basichas
(74) *Attorney, Agent, or Firm* — John Wustenberg; Parker Justiss, P.C.

(57) ABSTRACT

A well test burner system has a plurality of burner nozzles supported by a support structure. Each burner nozzle has an air inlet, a well product inlet and an air/well product mixture outlet. At least one of the burner nozzles is supported to pivot relative to the support structure while the burner nozzle is operating to expel air/well product mixture.

20 Claims, 3 Drawing Sheets

(56) References Cited

U.S. PATENT DOCUMENTS

| | | | | |
|---|---|---|---|---|
| 3,894,831 | A * | 7/1975 | Glotin | E21B 41/0071 431/10 |
| 3,980,416 | A * | 9/1976 | Goncalves | E21B 41/0071 431/190 |
| 4,011,995 | A | 3/1977 | Krause, Jr. | |
| 4,270,561 | A | 6/1981 | Bjorklund | |
| 4,348,171 | A * | 9/1982 | Issenmann | E21B 41/0071 431/202 |
| 4,412,811 | A | 11/1983 | Pedrosa, Jr. | |
| 4,655,706 | A | 4/1987 | Bayh, III | |
| 5,044,558 | A | 9/1991 | Young et al. | |
| 5,058,808 | A | 10/1991 | Young | |
| 5,096,124 | A | 3/1992 | Young | |
| 5,360,334 | A | 11/1994 | Kagi, Sr. | |
| 5,464,344 | A | 11/1995 | Hufton | |
| 5,636,980 | A | 6/1997 | Young | |
| 5,918,670 | A | 7/1999 | Coutts et al. | |
| 5,993,196 | A | 11/1999 | Young et al. | |
| 6,027,332 | A | 2/2000 | Glotin et al. | |
| 6,036,479 | A | 3/2000 | Dubach et al. | |
| 7,566,217 | B2 | 7/2009 | Morsner | |
| 2006/0127831 | A1 | 6/2006 | Kagi, Sr. | |
| 2007/0248920 | A1 | 10/2007 | Morsner | |
| 2010/0209862 | A1* | 8/2010 | Hahn | F23D 14/56 431/350 |
| 2011/0226218 | A1 | 9/2011 | Vongsateanchai | |
| 2013/0000693 | A1* | 1/2013 | Waterhouse | F24J 2/5233 136/246 |

FOREIGN PATENT DOCUMENTS

| | | |
|---|---|---|
| JP | 11022915 | 1/1999 |
| WO | WO94-08178 | 4/1994 |

OTHER PUBLICATIONS

"The Derwent Environmental Crude Oil Burner," DPIR Ltd., Nicosia, Cyrpus, Jul. 2011, 3 pages.
"Sea Emerald Burner System," EXPRO, Jun. 2011, 2 pages.
"EverGreen Burner Fallout-free and smokeless liquid hydrocarbon combustion," Schlumberger, Apr. 2011, 2 pages.
"Peacock Oil Burner," Flare Industries, Inc., Apr. 2009, 2 pages.
"Flare Systems," John Zink Company LLC, 2001, 3 pages.
PCT International Search Report and Written Opinion of the International Searching Authority, PCT/US2013/024281, dated Oct. 22, 2013, 14 pages.
Cody et al., "Vertically Arranged Well Test Burner System", PCT/US2013/024266, Feb. 1, 2013, 12 pages.
Cody et al., "Signal Responsive Well Test Burner", PCT/US2013/024275, Feb. 1, 2013, 15 pages.
Cody, "Variable Air to Product Ratio Well Burner Nozzle", PCT/US2013/024264, Feb. 1, 2013, 15 pages.

* cited by examiner

AIMABLE WELL TEST BURNER SYSTEM

CROSS-REFERENCE TO RELATED APPLICATIONS

This application is U.S. National Phase Application of and claims the benefit of priority to International Application Serial No. PCT/US2013/024281, filed on Feb. 1, 2013, the entire contents of which are hereby incorporated by reference.

BACKGROUND

Prior to connecting a well to a production pipeline, a well test is performed where the well is produced and the production evaluated. The product collected from the well (e.g., crude oil and gas) must be disposed of. In certain instances, the product is separated and a portion of the product (e.g., substantially crude) is disposed of by burning using a surface well test burner system. For example, on an offshore drilling platform, the well test burner system is often mounted at the end of a boom that extends outward from the side of the platform. As the well is tested, the crude is piped out the boom to the well test burner system and burned. Well test burner systems are also sometimes used on land-based wells.

The burning well product produces a large amount of heat. Therefore, well test burner systems typically have heat shields to reduce the amount of heat radiated back to the platform. The effectiveness of the heat shields depends on the shielding being between the flame of the burning well product and the platform. As wind shifts, it effects the direction of the flame and can blow the flame away from the heat shields, and in certain instances, back towards the platform. Thus, in setting up a well test burner system, the well test burner system is oriented to account for the wind direction.

DESCRIPTION OF DRAWINGS

Like reference symbols in the various drawings indicate like elements.

DETAILED DESCRIPTION

Figure 1:
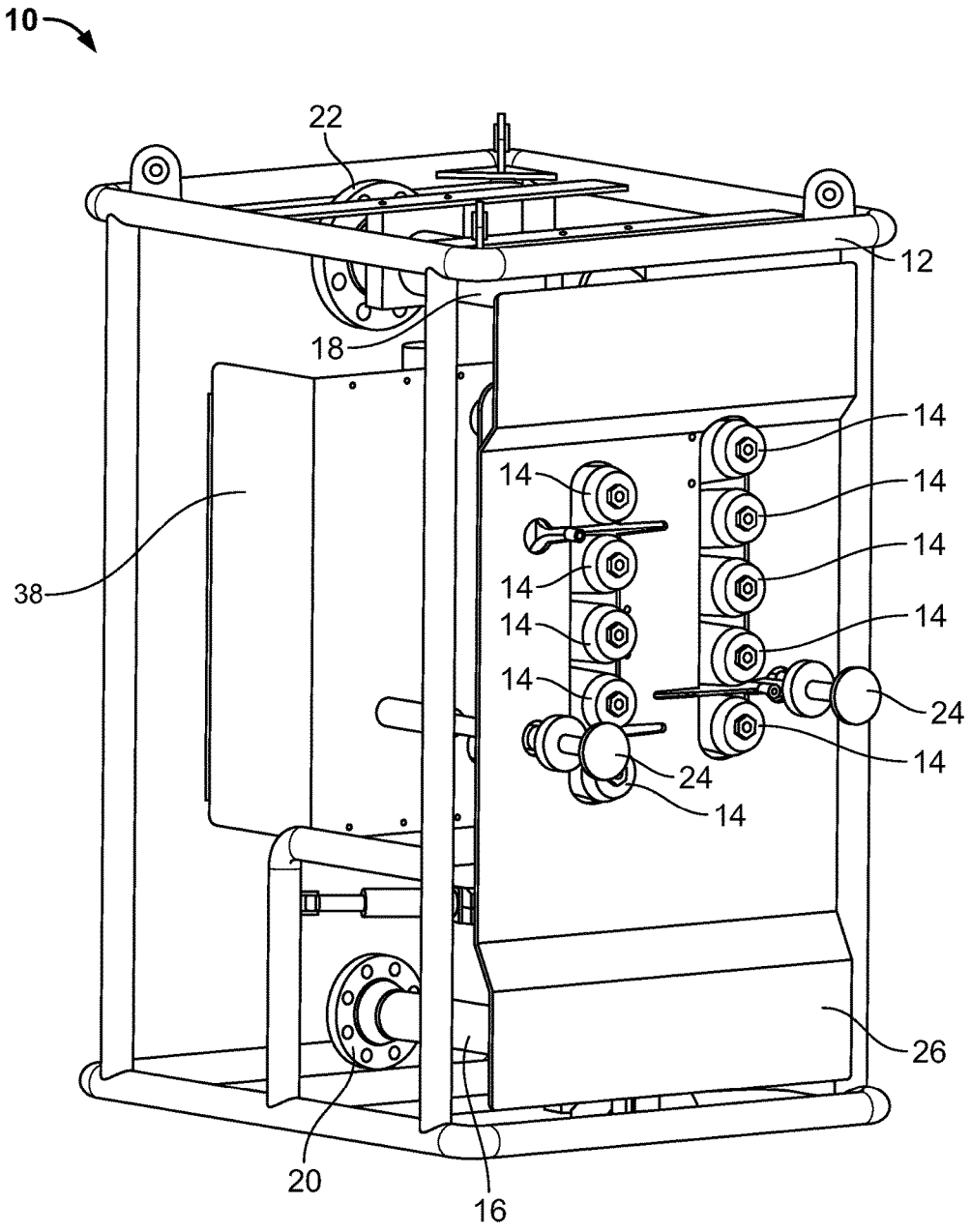
FIG. 1 is a perspective view of an example well test burner system.

FIG. 1 is a perspective view of an example well test burner system 10. The well test burner system 10 is of a type that could be used to burn product produced from a well (e.g., substantially crude oil), for example, during its test phase. In certain instances, the well test burner system 10 is mounted to a boom extending outward from the side of an offshore drilling platform. Alternately, the well test burner system 10 could be mounted to a skid for use with a land-based well.

The well test burner system 10 includes a frame 12 that carries the other components of the well test burner system 10 and is adapted to be mounted to a boom or a skid. The frame 12 is shown as being tubular and defining a substantially cubic rectangular shape, but could be other configurations.

Figure 2:
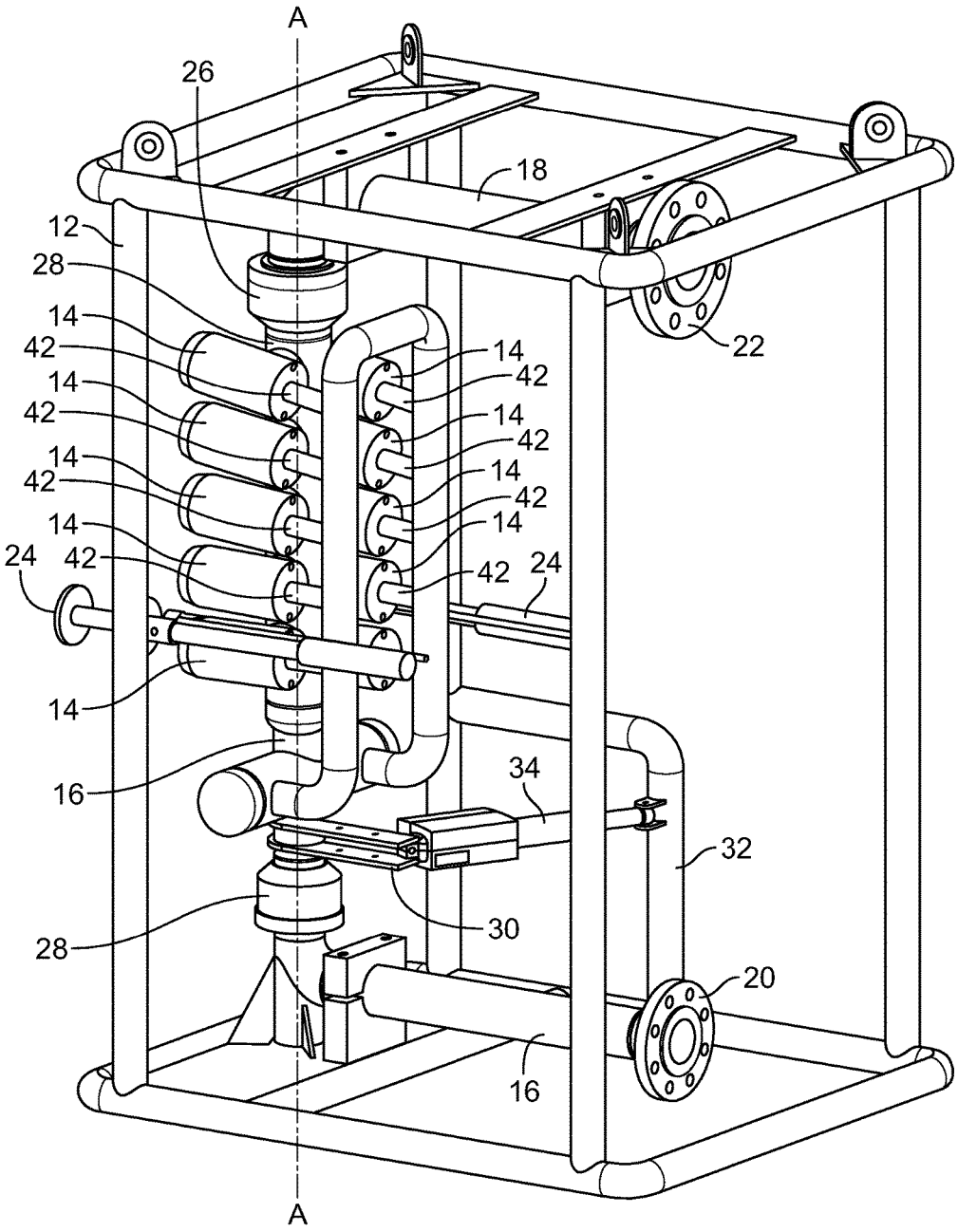
FIG. 2 is a rear, side perspective view of the example well test burner system of FIG. 1 with the heat shields removed.

The frame 12 carries one or more burner nozzles 14 adapted to receive air and well product, combine the air and well product, and expel an air/well product mixture for burning through an outlet. The burner nozzles 14 are carried on a common air inlet pipe 18 attached to the frame 12. The air inlet pipe 18 extends horizontally from the back to the front of the well test burner system 10, and then turns vertical along vertical axis A-A. In the vicinity of the burner nozzles, the inlet pipe 18 is straight and vertical. Each of the burner nozzles 14 has an air inlet 36 (FIG. 3A) coupled to receive a supply of air from the inlet pipe 18. Each of the burner nozzles 14 also has a well product inlet 42 (FIG. 2) coupled to receive a supply of well product from a well product inlet pipe 16. Like the air inlet pipe 18, the well product inlet pipe 16 extends horizontally from the back to the front of the well test burner system 10, and then turns vertical along axis A-A. The well product inlet pipe 16 structurally connects with the air inlet pipe 18 along the common vertical axis A-A, but does not communicate fluids. In certain instances, the air inlet pipe 18 and the product inlet pipe 16 are rigid pipes (as opposed to flexible hose). The pipes are provided with flanges 22, 20, respectively, to couple to a line from an air compressor and a line providing the well product to be disposed of.

FIG. 1 shows ten burner nozzles 14 arranged in two vertical columns, each column having a set of five burner nozzles 14. Fewer or more burner nozzles 14 could be provided, and they can be arranged in fewer (e.g., one) or more columns. Also, the number of burner nozzles 14 in each set does not need to be equal. In FIG. 1, all of the burner nozzles 14 are arranged in columns. In other instances, the well test burner system 10 could be provided with additional burner nozzles 14 not arranged in a column. In FIG. 1, the well product inlet pipe 16 splits, having a leg that feeds each column of burner nozzles 14. In instances having only one column of burner nozzles 14, the well product inlet pipe 16 need not split. In instances having more than two columns of burner nozzles 14, the well product inlet pipe 16 can split to provide a leg for each column. In yet other instances, one central well product inlet pipe 16 can carry the burner nozzles 14, and the air inlet pipe 18 can be split to accommodate multiple columns. Yet other configurations are within the concepts herein.

The vertical portion of the air inlet pipe 18 includes a swivel joint 26 and the vertical portion of the well product inlet pipe 16 (below any split) includes a swivel joint 28. The swivel joints 26, 28 allow the vertical portion of the pipes 16, 18 (including any split portion of the pipes) to swivel or pivot about the vertical axis A-A. As the burner nozzles 14 are carried on the air inlet pipe 18, swiveling the pipes 16, 18 also changes the orientation of the burner nozzles 14 in unison relative to the frame 12 and the platform. The burner nozzles 14 swivel in unison. The swivel joints 26, 28 are of a type that include a seal that maintains a seal against leakage of the air or well product from the interior of the pipes 16, 18 to the exterior surroundings while swiveling. Such swivel joints 26, 28 enable the orientation of the burner nozzles 14 to be changed while the burner nozzles 14 are receiving air and well product and outputting the air/well product mixture. In certain instances, the swivel joints 26, 28 can include a bearing system (e.g., ball bearings) to facilitate swiveling the joint while under pressure of the air and well product supply.

As shown in the figures, the burner nozzles 14 can be arranged in a precise vertical column, within a reasonable manufacturing tolerance, with the outlet of each on a common precise vertical line. In other instances, the arrangement can be not precisely vertical, for example, with the column being tilted yet more vertical than horizontal and/or the outlets of some or all of the nozzles 14 not precisely on the same line. The vertical column arrangement, whether precise or not, is adapted to facilitate vertical cross-lighting between adjacent burner nozzles 14 in that the nozzles 14 are positioned so the flame produced by a lower burner nozzle 14 tends to travel upward and light or maintain lit at least the immediately adjacent, higher burner nozzle 14.

The flat flame produced by the burner nozzles 14 arranged in a column has a smaller surface area visible to the platform than a shape that projects more laterally. Therefore, the flat flame radiates less heat toward the boom and other components of the platform. The frame 12 further carries one or more heat shields to reduce transmission of heat from the burning product to components of the burner system 10, as well as to the boom and other components of the platform. In certain instances, a primary heat shield 26 is mounted together with the burner nozzles 14 and spans substantially the entire front of the frame 12. The heat shield 26, thus, swivels or pivots with the burner nozzles 14. In a configuration where the frame 12 is a cubic rectangular shape, the larger dimension of the rectangle can be aligned with the height of the flat flame. The resulting primary heat shield 26 can then block a larger portion of the radiative heat emitted from the flat flame toward the platform. The frame 12 can also include one or more secondary heat shields to further protect other components of the burner system 10. For example, a secondary heat shield 38 is shown surrounding a control box of the burner system 10. Fewer or more heat shields can be provided.

The frame 12 carries one or more pilot burners 24 that are coupled to receive a supply of pilot gas. Specifically, the pilot burners 24 are mounted to the air inlet pipe 18 to swivel with the pipe 18 and the burner nozzles 14. The pilot burners 24 burn the pilot gas to maintain a pilot flame that lights the air/product mixture expelled from burner nozzles 14. In certain instances, the pilot gas is not a gas collected from the well, but rather a separate supply of clean gas. Two pilot burners 24 are shown flanking the columns of burner nozzles 14. Each pilot burner 24 is positioned vertically between the vertically lowest burner nozzle 14 and an adjacent burner nozzle 14. In the configuration of FIG. 1, the outlets of the pilot burners 24 are oriented to produce a horizontal pilot flame directed inward, transversely across the vertical column of burner nozzles 14, such that the pilot burner 24 on one side produces a flame directed toward the opposite pilot burner 24. In certain instances, the columns of burner nozzles 14 can be slightly vertically offset from one another such that a pilot burner 24 positioned between the vertically lowest and its adjacent burner nozzle 14 of one column will produce a flame that is vertically aligned with the outlet of a burner nozzle 14 in the adjacent column. Therefore, each of the pilot burners 24 produce a flame positioned to light two burner nozzles 14 in the adjacent column, and in certain instances, also light a burner nozzle 14 of the opposite column. The horizontally firing pilot burners 24 facilitates lighting the burner nozzles 14 arranged in columns, because no matter which direction the wind blows the flame from the pilot burner 24, the flame always crosses a burner nozzle 14. For example, in a cross wind, the pilot flame of the upwind pilot burner 24 will remain positioned to light two burner nozzles 14 in the adjacent column, and if so configured, a burner nozzle 14 of the opposite column. A gust with a vertical upward or downward component may redirect the pilot flame, but the flame will continue to cross (and thus light) a burner nozzle 14. Also, because the burner nozzles 14 are arranged to cross-light, only one pilot burner 24 is needed for each column to light the lowest or the lower two most burner nozzles 14. The lowest or second lowest will, in turn, light the adjacent burner nozzle 14, which will light its adjacent burner nozzle, until all burner nozzles 14 in a column are burning.

Figure 3B:
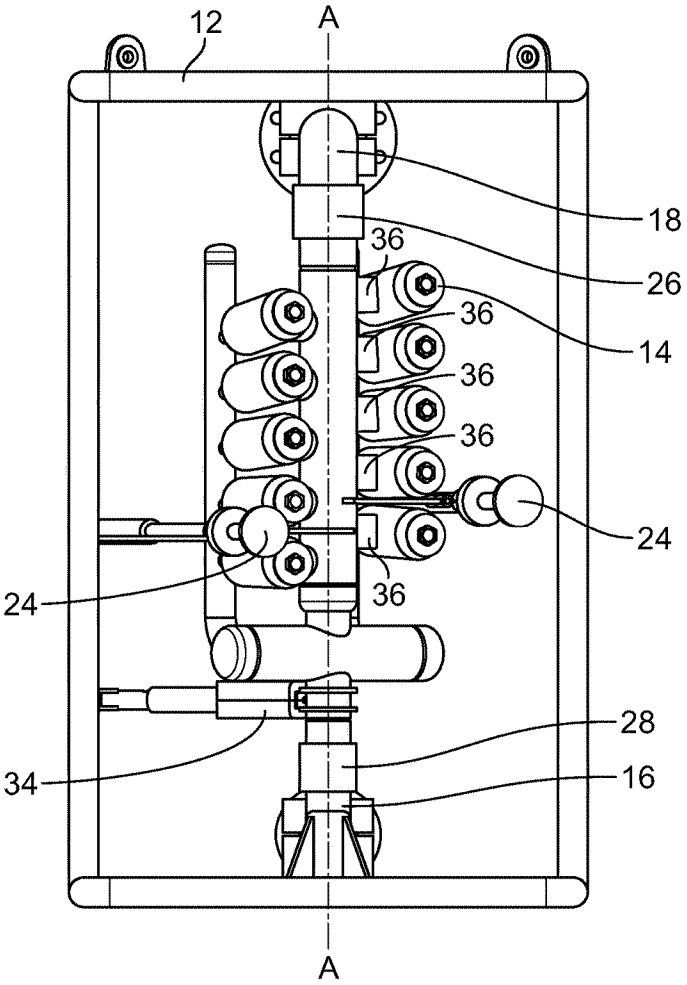
FIGS. 3A and 3B are front views of the example well test burner systems of FIG. 1 with the heat shields removed, showing the burner nozzles oriented in different directions.
Figure 3A:
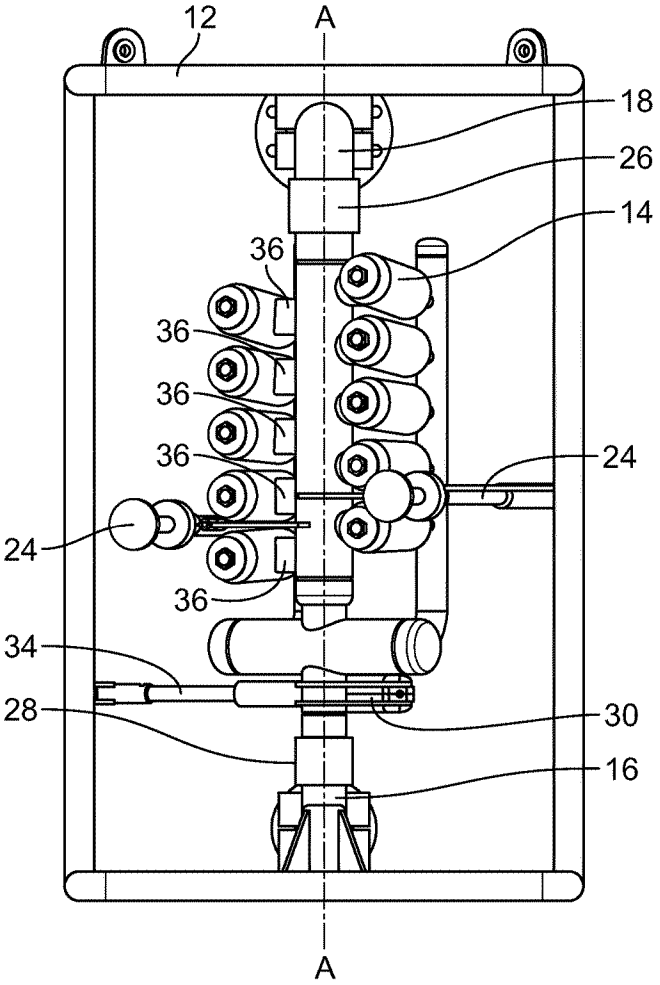

In certain instances, the well test burner system 10 can be provided with a linear actuator 34 that can swivel the burner nozzles 14 in response to a remote signal. The linear actuator 34, for example, can be controlled by and receive signals from a central control room on the platform and/or another controller apart from the well test burner system 10. The linear actuator 34 is attached between a leg 32 of the frame 12 and a moment arm 30 affixed to the vertical portion of the well product inlet pipe 16 above the swivel 28. When the linear actuator extends beyond a mid-extension, it swivels the burner nozzles 14 toward one side (FIG. 3A), and when the linear actuator retracts from the mid extension, it swivels the burner nozzles 14 toward the other side (FIG. 3B). In certain instances, the actuator can be an electric actuator, responsive to electric signals. However, other types of actuators can be used. The linear actuator 34 can be controlled by a control algorithm that controls the orientation of the burner nozzles 14 based, in part, on wind direction and/or can be controlled manually.

In operation, the burner nozzles 14 of the well test burner system 10 are swiveled to a specified initial orientation based, in part, on the wind direction, and the well test burner system 10 is started and subsequently operated to burn well product. If the wind direction changes, the burner nozzles 14 can be swiveled to a new specified orientation to account for the change in wind direction, for example, to reduce the amount the flame visible and radiating back to the platform. The burner nozzles 14 can be swiveled to the new specified orientation without interrupting the output of air/well product mixture, and thus without extinguishing the flame. In an instance having a linear actuator 34, the actuator can be signaled to swivel the burner nozzles 14 to the new specified orientation. The ability to re-orient the burner nozzles 14 while continuing to burn the well product saves time in shutdown and restart of the well test burner system when the wind changes. This also allows such quick response to wind adjustments that heat can be quickly mitigated if the wind direction causes it to increase.

A number of embodiments have been described. Nevertheless, it will be understood that various modifications may be made. Accordingly, other embodiments are within the scope of the following claims.

What is claimed is:

1. A well test burner system, comprising:

a frame having a 3-dimensional perimeter;

an air inlet pipe and a well product inlet pipe located at least partially within the 3-dimensional perimeter;

a plurality of burner nozzles carried by the frame and located at least partially within the 3-dimensional perimeter of the frame, each adapted to receive a supply of air and well product from the air inlet pipe and well product inlet pipe, respectively, and output air/well product mixture; and at least one of the burner nozzles carried to swivel relative to the frame while the burner nozzle is outputting air/well product mixture.

2. The well test burner system of claim 1, where the burner nozzles carried to swivel on a vertical axis.

3. The well test burner of claim 1, comprising a supply tubing fluidically coupled to an inlet of the at least one of the burner nozzles, the supply tubing comprising a swivel joint.

4. The well test burner of claim 3, where the swivel joint is sealed against passage of fluid from an interior of the tubing to the exterior of the tubing during swiveling.

5. The well test burner of claim 3, comprising a second supply tubing fluidically coupled to a second inlet of the at least one of the burner nozzles and comprising a second swivel joint.

6. The well test burner of claim 5, where the first and second supply tubing extend from the air inlet pipe and well product inlet pipe, respectively.

7. The well test burner system of claim 1, where the burner nozzles are arranged in at least one vertical column.

8. The well test burner system of claim 7, where the burner nozzles are arranged into two parallel, vertical columns carried to swivel in unison.

9. The well test burner system of claim 8, comprising a first and second pilot burners flanking the two vertical columns of burner nozzles and each pilot burner is oriented to direct a pilot flame toward the other pilot burner.

10. The well test burner system of claim 1, where all of the burner nozzles of the well test system are carried by a common swivel joint.

11. The well test burner system of claim 1, comprising a pilot burner residing adjacent a vertically lowest burner nozzle.

12. The well test burner of claim 1, comprising a linear actuator located within the 3-dimensional perimeter and coupled to the at least one of the burner nozzles operable to swivel the at least one of the burner nozzles in response to a signal originating remote from the well test burner.

13. The well test burner of claim 12, further including a nozzle support structure carrying the at least one of the burner nozzles, the nozzle support structure comprising a swivel joint; and where the linear actuator is coupled to the frame and to the nozzle support structure.

14. A method, comprising:

receiving a supply of air and well product at a burner nozzle located at least partially within a frame having a 3-dimensional perimeter;

outputting air/well product mixture from the burner nozzle in a specified direction; and reorienting the burner nozzle relative to the frame while outputting air/well product mixture.

15. The method of claim 14, where receiving a supply of air and well product mixture comprises receiving a supply of air and well product mixture at a plurality of burner nozzles arranged in a vertical column;

where outputting air/well product mixture from the burner nozzle in a specified direction comprises outputting air/well product mixture from the plurality of burner nozzles in the specified direction.

16. The method of claim 15, where reorienting the burner nozzle relative to the frame while outputting air/well product mixture comprises reorienting the burner nozzles relative to the frame in unison while outputting air/well product mixture from at least a subset of the plurality of burner nozzles.

17. The method of claim 14, where reorienting the burner nozzle while outputting air/well product mixture comprises reorienting in response to a remote originating signal.

18. A system, comprising:

a plurality of well test burner nozzles located at least partially within and carried on a support structure having a 3-dimensional perimeter, at least one of the burner nozzles supported to pivot relative to the support structure while the burner nozzle is operating to expel air/well product mixture.

19. The system of claim 18, where the at least one of the burner nozzles supported to pivot is supported to pivot about a vertical axis.

20. The system of claim 18, where the at least one of the burner nozzles supported to pivot comprises more than one of the burner nozzles and the more than one of the burner nozzles is supported on a common swivel joint.

* * * * *